US006396366B1

(12) United States Patent
Räty et al.

(10) Patent No.: US 6,396,366 B1
(45) Date of Patent: May 28, 2002

(54) COAXIAL CAVITY RESONATOR

(75) Inventors: Tuomo Räty; Antti Kanervo, both of Raahe (FI)

(73) Assignee: Allgon AB, Taby (SE)

( * ) Notice: Subject to any disclaimer, the term of this patent is extended or adjusted under 35 U.S.C. 154(b) by 0 days.

(21) Appl. No.: 09/774,179

(22) PCT Filed: Aug. 12, 1999

(86) PCT No.: PCT/SE99/01368

§ 371 (c)(1),
(2), (4) Date: Apr. 16, 2001

(87) PCT Pub. No.: WO00/10220

PCT Pub. Date: Feb. 24, 2000

(30) Foreign Application Priority Data

Aug. 12, 1998 (SE) ..... 9802714

(51) Int. Cl.[7] ..... H01P 7/04
(52) U.S. Cl. ..... 333/222
(58) Field of Search ..... 333/222, 223, 333/224, 230

(56) References Cited

U.S. PATENT DOCUMENTS 2,245,597 A * 6/1941 Lindenblad ..... 331/102
5,285,178 A * 2/1994 Ahlberg ..... 333/224

* cited by examiner

*Primary Examiner*—Robert Pascal
*Assistant Examiner*—Dean Takaoka
(74) *Attorney, Agent, or Firm*—Jacobson Holman, PLLC

(57) ABSTRACT

The construction is a coaxial cavity resonator (20, 30, 40, 50) comprising at least one conductive body (11, 31), which body is open at one end and shortened from a quarter-wave resonator. The conductive body includes a main rod (16), which is in one end attached to the cavity wall (15), and a main disc (17) attached to the free end of the main rod (16). The cavity (12) further comprises one or more conductive plates (21, 41, 51) located between the main disc (17) and the side walls (13), at the first side (17*a*) of, and out of galvanic contact with, the main disc (17). The shortening is carried out by creating air-insulated extra capacitance between the resonator cavity walls via the conductive plates and a mechanical structure at the open end of the conductive body.

13 Claims, 2 Drawing Sheets

COAXIAL CAVITY RESONATOR

TECHNICAL FIELD

The present invention relates to a coaxial cavity resonator defined in the preamble of claim 1, which is particularly suitable for a structural part of a filter in radio devices.

BACKGROUND TO THE INVENTION

Resonators are used as the main structural part in the manufacture of oscillators and filters. The important characteristics of resonators include, for example Q-value, size, mechanical stability, temperature and humidity stability and manufacturing costs.

The resonator constructions that are known so far include the following:

1) Resonators Compiled of Discrete Components, Such as Capacitors and Inductors

Resonators of this kind entail the drawback of internal dissipation of the components and therefore clearly lower Q-values compared to the other types.

2) Microstrip Resonators

A microstrip resonator is formed in the conductor areas on the surface of a circuit board, for example. The drawback is radiation dissipation caused by the open construction and thus relatively low Q-values.

3) Transmission Line Resonators

In a transmission line resonator, the oscillator consists of a certain length of a transmission line of a suitable type. When a twin cable or coaxial cable is used, the drawback is relatively high dissipation and a relatively poor stability. When a waveguide is used, stability can be improved, but the dissipation is still relatively high because of radiation when the end of the pipe is open. The construction can also be unpractical large. A closed, relatively short waveguide resonator is regarded as a cavity resonator, which is dealt with later.

4) Coaxial Cavity Resonators

Resonators of this type have a construction which is not merely a piece of coaxial cable but a unit which was originally intended as a resonator. It includes, among other things, an inner conductor and an outer conductor, which are air-insulated from each other, and a conductive cover, which is connected with the outer conductor. A relatively good result can be achieved by this construction. The length of the resonator is at least in the order of one fourth of the wavelength, $\lambda/4$, of the variable field effective in it, which is a drawback when aiming at minimising the size. The width can be reduced by reducing the sides of the outer conductor and the diameter of the inner conductors. However, this leads to an increase of resistive dissipation. In addition, because of the reduction in the thickness of the construction, it may be necessary to support the inner conductor by a piece made of a dielectric material, which causes considerable extra dissipation in the form of dielectric loss and increases the manufacturing costs.

5) Helix-resonators

This type is a modification of a coaxial resonator, in which the cylindrical inner conductor is replaced by a helical conductor. Thus the size of the resonator is reduced, but the clearly increased dissipation is a drawback. Dissipation is due to the small diameter of the inner conductor.

6) Cavity Resonators

Resonators of this type are hollow pieces made of a conductive material, in which electromagnetic oscillation can be excited. The resonator can be rectangular, cylindrical or spherical in shape. Very low dissipation can be achieved with cavity resonators. However, their size is a drawback when the aim is to minimise the size of the construction.

7) Dielectric Resonators

Coaxial cables or a closed conducting surface is formed on the surface of the dielectric piece. The advantage is that the construction can be made in a small size. Relatively low dissipation can also be achieved. On the other hand, dielectric resonators have the drawback of relatively high manufacturing costs.

8) Hat Resonators

A subclass of coaxial cavity resonators, here called hat resonators are well described as prior art in U.S. Pat. No. 4,292,610 by Makimoto, see FIG. 1. This type of resonator is a coaxial cavity resonator, as described above, with an additional disc on the open end of the waveguide, having a larger diameter than the waveguide. The advantage is that the construction can be made in a small size. Relatively low dissipation can also be achieved. The surface area of the disc and distances to the walls of the resonator are dimensioned so that due to the extra capacitance created between the disc and the cavity, the resonator can be made substantially smaller.

A further development of the hat resonator is described in U.S. Pat. No. 3,496,498 by Kawahashi et al and in JP 57-136804 A by Mitsubishi, where a multiple of discs, or grooves, are arranged on a resonator rod along the whole length of the resonator rod. By increasing the capacitive coupling to the cavity wall, the physical length of the conductive body may be reduced. A drawback with this type of multiple disc resonator is that the Q-value of the resonator decreases compared to the Q-value of the hat resonator.

Another coaxial cavity resonator having a reduced size is described in U.S. Pat. No. 3,448,412 by E. C. Johnson, where the conductive body and the interior of the cavity have intermeshing concentric tubular members that simulates a folded coaxial line. The size of the resonator is further reduced by a capacitive coupling between the top part of the conductive body and the interior of the housing, such as a hat resonator described above. Although this resonator has a reduced size it is still fairly large in size and will have the drawback of being mechanical unstable if the volume of the cavity is reduced, due to the design of the conductive body.

SUMMARY OF THE INVENTION

The object with the present invention is to provide a coaxial cavity resonator having a small size, good mechanical stability and a high Q-value compared to the above mentioned prior art.

A coaxial cavity resonator, that is an elaborate hat resonator, according to the invention is characterised in what is set forth in the independent claim. Some preferred embodiments of the invention are set forth in the dependent claims.

The basic idea of the invention is the following: The construction is a coaxial cavity resonator comprising at least one conductive body, which body is open at one end and shortened from a quarter-wave resonator. The conductive body includes a main rod, which is in one end attached to the cavity wall, and a main disc attached to the free end of the main rod. The cavity further comprise one or more conductive plates located between the main disc and the side walls, at the first side of, and out of galvanic contact with, the main disc, to create extra capacitive couplings between the main disc and the cavity walls via the plate(s). Additional discs may also be attached to the main rod. The shortening is carried out by creating air-insulated extra capacitance between the resonator cavity walls via the conductive plates and a mechanical structure at the open end of the conductive body.

The invention has the advantage that because of the manner of increasing the capacitance, the resonator can be made substantially smaller than a prior art quarter-wave resonator, which has the same Q-value. The improvement achieved can also be used partly for saving space and partly for maintaining a high Q-value compared to the Q-value for a resonator with a single top capacitance, such as a tuning screw.

Furthermore, a smaller resonator according to the present invention has the advantage to allow the volume of the cavity to be substantially smaller for a specific frequency, compared to prior art solutions.

In addition, the invention has the advantage that when the resonator is shortened it becomes mechanically stronger and therefore also more stable with regard to its electrical properties. Support pieces that increase the dissipation are not needed in it, either.

In the following, the invention will be described in more detail with reference to the accompanying drawings.

PREFERRED EMBODIMENTS

Figure 1:
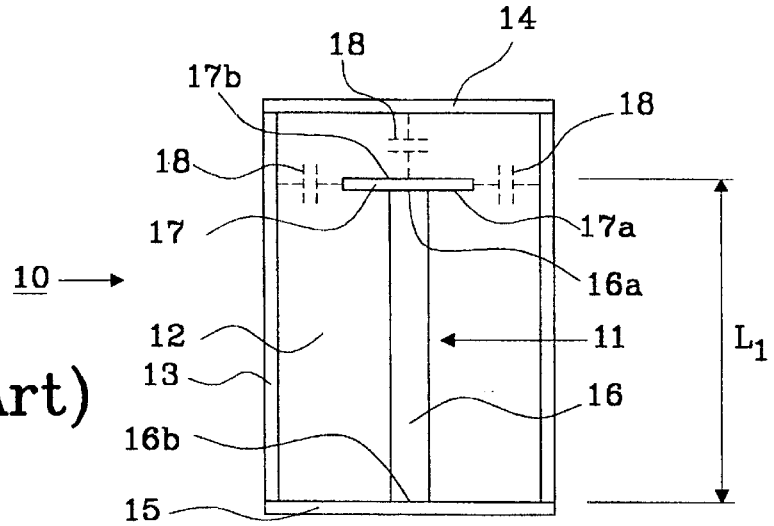
Fig. 1 (Prior Art)
FIG. 1 shows a prior art coaxial cavity resonator.

FIG. 1 shows a hat resonator 10 according to prior art. It includes, among other things, a conductive body 11 located inside a cavity 12. The cavity 12 having side walls 13, a top wall 14 and a bottom wall 15. The conductive body 11 comprises a conductor rod 16 and a main conductor disc 17. An end 16*a* of the rod 16 is connected to a first side 17*a* of the main disc 17. A free end 16*b* of the conductor rod 16 is in short-circuit connection with the bottom wall 15 of the cavity 12. A second side 17*b*, opposite the first side 17*a*, of the main disc 17 is in open-circuit relation with the top wall 14 of said cavity 12. Capacitive coupling 18 between the disc 17 and the top wall 14 and side walls 13 of the cavity 12 shortens the required length $L_1$ of the conductive body 11 for operation at a specific frequency.

Figure 2A:
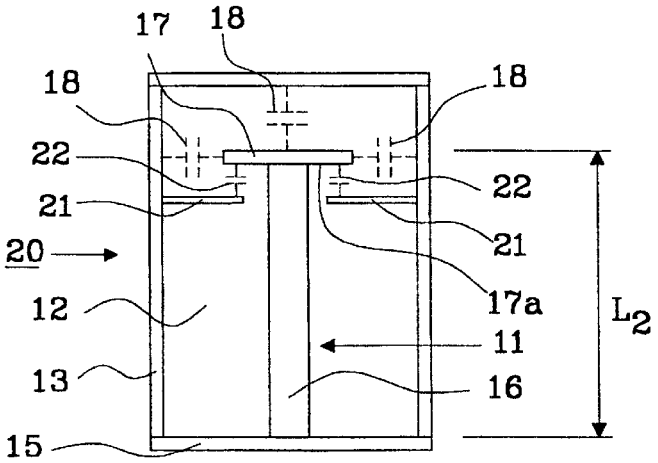
FIGS. 2*a* and 2*b* shows an embodiment of a coaxial cavity resonator according to the invention in respectively vertical and lateral position.
Figure 2B:
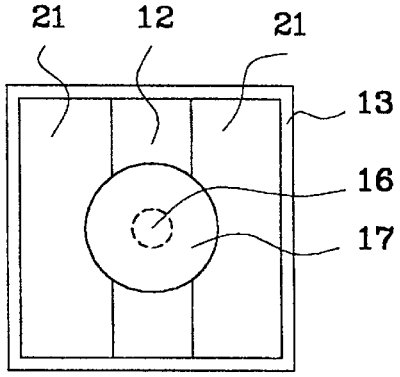

FIGS. 2*a* and 2*b* shows an improved embodiment of a hat resonator 20 according to the present invention, where one or more plates 21 are located in the cavity 12. The plate (s) 21 are positioned between the first side 17*a* of the main disc 17 and the bottom wall 15. It is essential that the plate(s) 21 have an electrical coupling to the cavity walls 13 and, at the same time, do not touch the conductive body 11, as this will short-circuit the conductive body (or at least parts of the conductive body) and thus change the function of the coaxial cavity resonator 20. The electrical coupling is preferably a short-circuit connection, but may be a capacitive coupling as shown in FIG. 5.

The plates 21 are preferably arranged in the same plane substantially parallel to the main disc 17. Thus obtaining an additional capacitive coupling 22 between the disc 17 and each plate 21. The increase in capacitive coupling leads to a decrease in physical length $L_2$, that is $L_1>L_2$, which in turn may make it possible to use a smaller cavity 12 for operation at a specific frequency. The plate(s) 21 may overlap each other but have to be arranged in a way to enable the conductor rod 16 to extend freely past each plate.

Figure 3:
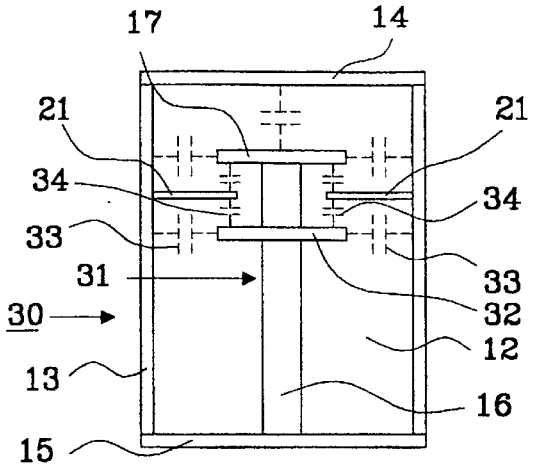
FIG. 3 shows another embodiment according to the present invention.

FIG. 3 shows another embodiment 30 of the present invention based on the previously shown embodiment in FIG. 2*a*, where the conductive body 31 further comprise an additional disc 32. The disc 32 being connected to said conductor rod 16 in parallel with the main disc 17 and located between the main plate(s) 21 and the bottom 15 wall of the cavity 12.

The total capacitive coupling may schematically described by a first capacitive coupling 18, between the conductive body 31 and the walls 13 and a second capacitive coupling 22, between the conductive body and the main plate(s) 21, increased by a first additional capacitive coupling 34, between the additional disc 32 and the main plate(s) 21, and a second additional capacitive coupling 33, between the additional disc 32 and the side wall 13. Other capacitive couplings may occur, such as between the proximity of the plate(s) 21 and the rod 16. The capacitive couplings described above represents electrical field energies that, according to the present invention, are more evenly distributed in the top region of the conductive body compared to prior art devices.

Figure 4:
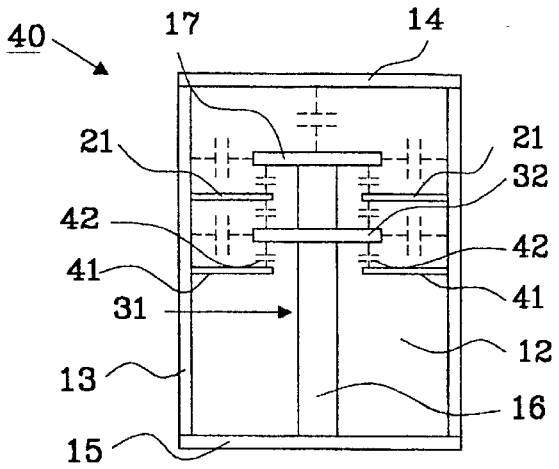
FIG. 4 shows a third embodiment according to the present invention.

FIG. 4 shows a third embodiment 40 of the present invention based on the previously shown embodiment in FIG. 3, where one or more additional plates 41 are located in the cavity 12. The additional plate(s) 41 are positioned between the additional disc 32 and the bottom wall of said cavity 15. It is essential that the main plate(s) 21 and the additional plate(s) 41 have an electrical coupling to the cavity walls 13 and, at the same time, do not touch the conductive body 31, as this will short-circuit the conductive body (or at least parts of the conductive body) and thus change the function of the coaxial cavity resonator 40.

The total capacitive coupling between the conductive body 31 and the walls 13, 14 and the main plate(s) 21 increases by an additional capacitive coupling 42 between the additional disc 32 and the additional plate(s) 41.

Figure 5A:
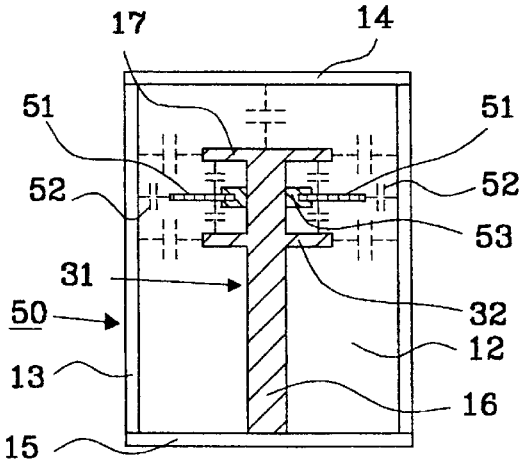
FIGS. 5*a* and 5*b* shows an alternative coupling of plates in the cavity according to the inventive concept in respectively vertical cross-section and lateral position.
Figure 5B:
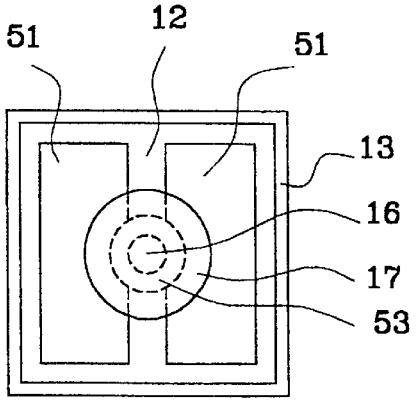

FIGS. 5*a* and 5*b* shows a coaxial cavity resonator 50 having an alternative way of positioning one or more plates 51 in the cavity 12 to obtain a capacitive coupling 52 between the plate(s) 51 and the cavity wall 13. The plate(s) being in a predetermined position by attaching them to a support 53 made out of a dielectric material. The support is in turn securely attached to the conductive body 31 at a desired location.

More additional discs may be connected to the conductor rod in a similar way and additional sets of plates may be placed inside the cavity to increase the capacitive coupling between the conductive body and the cavity walls.

The main disc and the additional disc(s) and the main plate(s) and the additional plate(s) may have tuning means to adjust the resonance frequency of the resonator. Such tuning means may comprise one or several bendable conductive tongues, preferably arranged on said platens), as shown in FIG. 6.

Figure 6:
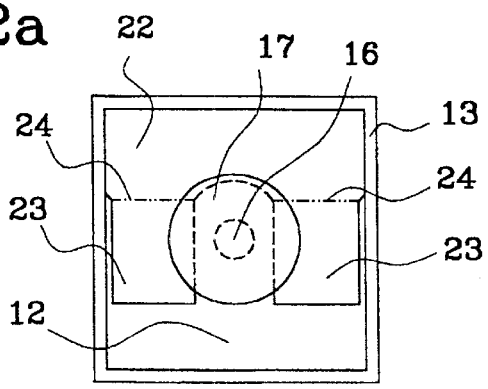
FIG. 6 shows an alternative embodiment of the main plates of the coaxial cavity resonator in FIGS. 2*a* and 2*b*.

FIG. 6 shows a lateral view of an alternative embodiment of a coaxial cavity resonator as shown in FIG. 2*a* and 2*b*, where the main plates 21 are replaced with a single plate 22 with tuning means in the form of tongues 23. The tongues 23 are bendable along a line 24, so that each tongue 23 may be bent closer to or further away from the main disc 17. This way the resonance frequency may be adjusted.

The discs 17, 32 may be attached to the main rod in an arbitrary manor, but are preferably attached coaxially.

The discs may have an arbitrary thickness, and can of course have other shapes than circular discs. The discs in a conductive body may have different shape, when, for example, the coaxial cavity resonator are to be tuned for a specific frequency, the main disc may have a larger diameter than one or more of the additional discs.

The plate(s) used to increase the capacitive coupling may also have arbitrary shape and thickness.

As is clearly shown in the drawings of the preferred embodiments, the additional disc(s) 32 is/are arranged close to the open end of the conductive body 31, within a distance from the open end 17*b* of the conductive body 31, said distance being less than half the length $L_2$ of the conductive body 31.

The plate(s) 21, 41, 51 is/are located between the first side 17*a* of the main disc 17 and the bottom wall 15 of the cavity 12, close enough to the disc(s) 17, 32 of the conductive body 11, 31 to generate capacitive couplings mainly between the plate(s) and the adjacent disc(s). Furthermore, as is clear from the drawings, the plate(s) is/are coupled to at least one cavity wall 13 at a distance from the bottom wall 15, said distance being at least half the length $L_2$ of the conductive body 11, 31.

The reason for this is to minimise the capacitive coupling between the lower part of the main rod and the cavity walls, and concentrate the capacitive coupling between the open part of the conductive body and the corresponding upper part of the cavity. By doing this a high Q-value may be obtained for a specific frequency and, at the same time, the size of the resonator may be reduced.

What is claimed is:

1. A coaxial cavity resonator comprising:

walls delimiting a cavity (12) having side walls (13), a top wall (14) and a bottom wall (15) opposing said top wall, at least one cylindrical conductive body, comprising a conductor rod (16) and a main conductor disc (17), in said cavity (12), an end (16*a*) of said conductor rod (16) being connected to a first side (17*a*) of said main disc (17), a free end (16*b*) of said conductor rod (16) being in short-circuit connection with said bottom wall (15) of said cavity (12), and a second side (17*b*) of said main disc (17), opposite to said first side (17*a*), being in open-circuit relation with said top wall (14) of said cavity (12), characterised in that said cavity (12) further comprises one or more conductive main plates (21, 51) electrically coupled to the side walls (13) and out of galvanic contact with the conductive body (11, 31), and said main plate(s) (21, 51) being located between the main disc (17) and said side walls (13), at the first side (17*a*) of the main disc (17).

2. Coaxial cavity resonator according to claim 1, characterised in that said plate(s) (21, 51) are located a distance from the bottom wall (15) of said cavity (12), said distance being at least half the length ($L_2$) of the conductive body (11, 31).

3. Coaxial cavity resonator according to claim 1, characterised in that at least one of said plates (51) is capacitively coupled to the inside of at least one of said side walls (13) of said cavity (12).

4. Coaxial cavity resonator according to claim 1, characterised in that the plate(s) (21, 41, 51) is/are arranged substantially in parallel with said main disc (17).

5. Coaxial cavity resonator according to claim 1, characterised in that said disc(s) (17, 32) is/are coaxially connected to said rod (16).

6. Coaxial cavity resonator according to claim 1, characterised in that said discs (17, 31) have a substantially equal diameter.

7. Coaxial cavity resonator according to claim 1, characterised in that said plate(s) (21, 41) is/are attached to the inside of at least one of said side walls (13) of said cavity (12).

8. Coaxial cavity resonator according to claim 1, characterised in that said conductive body (31) further comprises at least one additional conductor disc (32) being connected to said conductor rod (16) substantially in parallel with said main disc (17) and between the main plate(s) (21, 51) and the bottom wall (15) of said cavity (12).

9. Coaxial cavity resonator according to claim 8, characterised in that said cavity (12) further comprises one or more conductive additional plates (41, 51) being located between at least two adjacent additional discs (32).

10. Coaxial cavity resonator according to claim 1, characterised in that said conductive body (31) further comprises at least one additional conductor disc (32) being connected to said conductor rod (16) substantially in parallel with said main disc (17) and between the main plate(s) (21, 51) and the main disc (17), and said cavity (12) further comprises one or more additional plates (41, 51) being located between at least two adjacent discs (17, 32) and out of contact with the conductive body (11, 31).

11. Coaxial cavity resonator according to claim 3, characterised in that each of said additional discs (32) being arranged to the rod (16) a distance from the second side (17*b*) of the main disc (17), said distance being less than half the length ($L_2$) of the conductive body (31).

12. Coaxial cavity resonator according to claim 1, characterised in that at least one of said plates (22) is provided with a tuning means (23), whereby the resonance frequency may be adjusted.

13. Coaxial cavity resonator according to claim 12, characterised in that said tuning means comprises at least one bendable conductive tongue (23).

* * * * *